United States Patent [19]

Hoshino

[11] Patent Number: 4,531,828

[45] Date of Patent: Jul. 30, 1985

[54] IMAGE RECEIVING MEMBER CONVEYING DEVICE OF A MULTIPLEX IMAGE FORMING APPARATUS

[75] Inventor: Osamu Hoshino, Tokyo, Japan

[73] Assignee: Canon Kabushiki Kaisha, Tokyo, Japan

[21] Appl. No.: 592,557

[22] Filed: Mar. 23, 1984

[30] Foreign Application Priority Data

Mar. 31, 1983 [JP] Japan ..... 58-56213

[51] Int. Cl.[3] ..... G03G 15/00

[52] U.S. Cl. ..... 355/3 SH; 355/4; 101/181

[58] Field of Search ..... 355/4, 3 SH, 14 SH; 101/181, 183

[56] References Cited

U.S. PATENT DOCUMENTS 4,162,843 7/1979 Inoue et al. ..... 355/4

*Primary Examiner*—A. T. Grimley

*Assistant Examiner*—David S. Warren

*Attorney, Agent, or Firm*—Fitzpatrick, Cella, Harper & Scinto

[57] ABSTRACT

This apparatus forms multiplex images on an image receiving member and prevents any misregistration between the images on the image receiving member by making the distance between adjacent ones of image processing stations disposed along the direction of conveyance of the image receiving member integer times the distance over which the image receiving member is conveyed by one full rotation of rotative driving means.

10 Claims, 8 Drawing Figures

IMAGE RECEIVING MEMBER CONVEYING DEVICE OF A MULTIPLEX IMAGE FORMING APPARATUS

BACKGROUND OF THE INVENTION

1. Field of the Invention

This invention relates to an apparatus in which a plurality of images are superposed on an image receiving member and formed into a multiplex image, and in particular to a conveying and driving device for conveying and directing the image receiving member to a plurality of image processing stations for forming images on the image receiving member.

2. Description of the Prior Art

As a multiplex image forming apparatus of this type, there is a color printer apparatus in which a sheet-like transfer medium as an image receiving member is conveyed while being electrostatically attracted to a conveyor belt and is caused to pass through the transfer stations of a plurality of image forming means in succession and a color image by multiplex transferred images is formed on the sheet-like transfer medium. In this apparatus, the sheet-like transfer medium is conveyed by the conveyor belt and multiplex transfer is effected on the sheet-like transfer medium in the transfer stations and therefore, the image misregistration on the transfer medium is greatly governed by the movement accuracy of the conveyor belt. Thus, the circularity of the driving roller for driving the conveyor belt must be maintained within very strict limits and a high rotational speed is required of the gear train operatively associated therewith.

SUMMARY OF THE INVENTION

It is an object of the present invention to provide a plurality of image processing stations for forming images on an image receiving member and to prevent any image misregistration from occurring on the image receiving member when a multiplex image is formed by forming images successively on the image receiving member.

It is also an object of the present invention to prevent occurrence of the image misregistration without extremely enhancing the accuracy of the parts of the image receiving member conveying means.

It is a further object of the present invention to provide a novel image receiving member conveying device improved in view of the prior art.

The present invention which achieves the above objects makes the distance between adjacent ones of a plurality of processing stations disposed along the direction of conveyance of the image receiving member for forming images on the image receiving member into integer times the distance over which the image receiving member is conveyed by one full rotation of rotative driving means for conveying the image receiving member.

The image receiving member may be in the form of a cut sheet or in the form of a long sheet. Conveyance of the image receiving member may be accomplished either by holding the image receiving member on an endless belt and driving the endless belt by rotative driving means or by directly conveying the image receiving member itself by rotative driving means. The plurality of image processing stations may be toner image forming units using the electrophotographic method, image forming units using an ink jet system, or image forming units using a heat transfer system. The multiplex image may generally be a color image formed by superposing toner images of different colors one upon another.

The invention will become more fully apparent from the following detailed description thereof taken in conjunction with the accompanying drawings.

DESCRIPTION OF THE PREFERRED EMBODIMENTS

Some specific embodiments of the present invention will hereinafter be described in detail by reference to the drawings.

Figure 1:
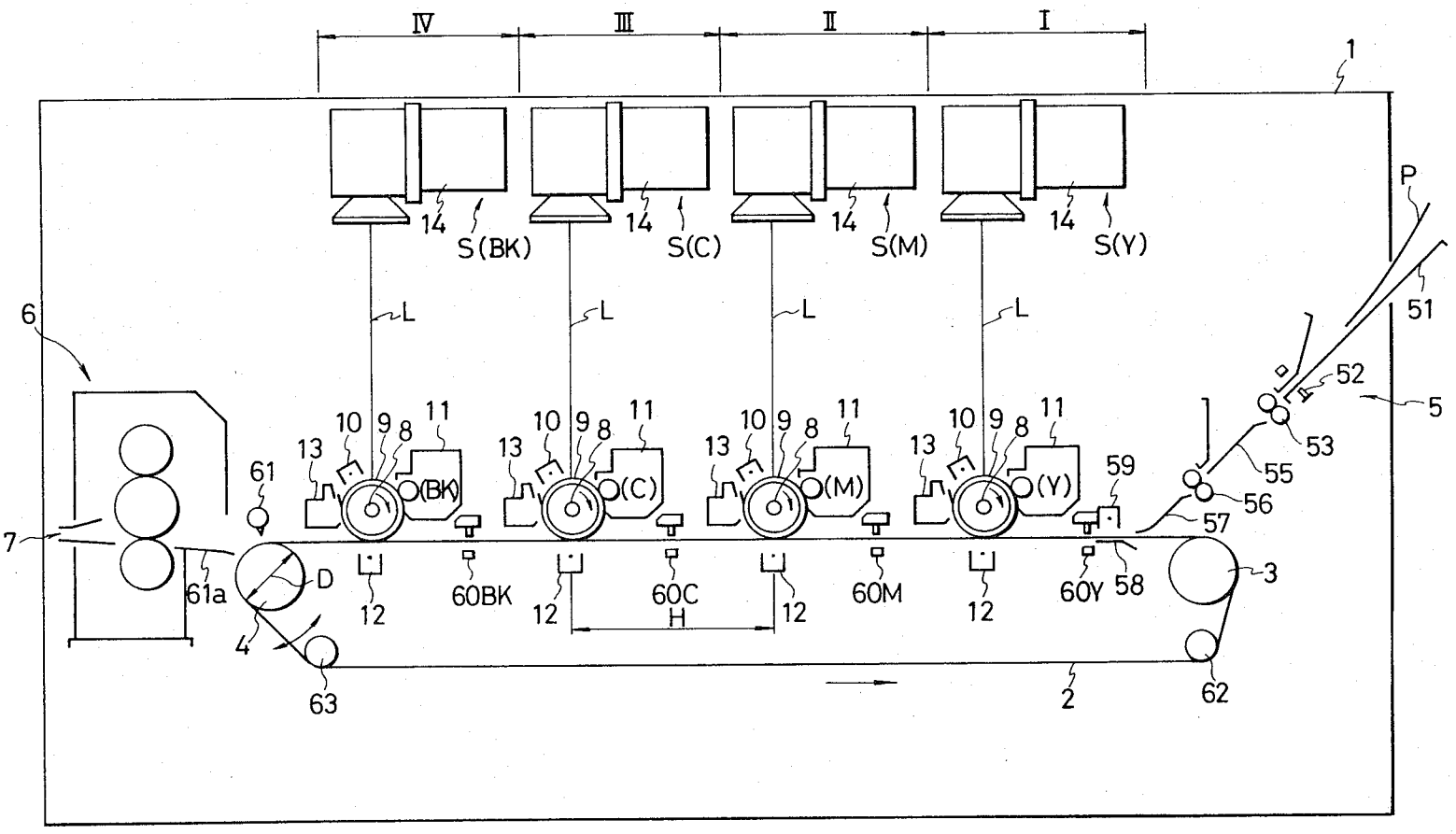
FIG. 1 is a cross-sectional view showing an embodiment of the present invention.

FIG. 1 is a cross-sectional view showing an embodiment of the present invention. The apparatus of the present embodiment comprises four sets of electrophotographic laser beam printer mechanisms contained as a plurality of sets of image forming mechanisms. In FIG. 1, reference numeral 1 designates the body housing of the apparatus, and reference numerals I, II, III and IV denote first to fourth laser beam printer mechanisms (hereinafter simply referred to as the printer mechanisms) disposed in succession from right to left in the body housing 1 as viewed in FIG. 1. Reference numerals 3 and 4 designate belt driving rollers disposed rightwardly obliquely downwardly of the first printer mechanism I and leftwardly obliquely downwardly of the fourth printer mechanism IV, respectively. The belt driving rollers 3 and 4 are rotatively driven by a drive source, not shown. An insulative screen belt 2 is passed over the belt driving rollers 3 and 4. This screen belt 2 is formed of meshes of Tetoron fibers and is moved counterclockwise, as indicated by the arrow, by the driving roller 4. Reference numeral 5 designates a paper supply mechanism disposed on the right side of the apparatus frame, reference numeral 6 denotes an image fixing device disposed on the left end side of the apparatus frame, and reference numeral 7 designates a discharge port for completed prints.

The printer mechanisms I–IV are substantially identical in construction. That is, each printer mechanism comprises a drum type electrophotographic photosensitive medium 9 (hereinafter simply referred to as the drum) having an electrically conductive base member and a photoconductive layer as a toner image bearing member rotatively driven in the clockwise direction of arrow about a shaft 8, and a charger 10, a developing device 11, a transfer discharger 12 and a cleaning device 13 which are successively disposed around the drum 9 in the direction of rotation of the drum, and a laser beam scanner 14 disposed above the drum 9.

The laser beam scanner 14 comprises a well-known semiconductor laser, a polygon mirror, an f-$\theta$ lens, a light-intercepting plate, etc. and receives as an input a time-sequential electrical digital picture element signal S put out from an image reading apparatus or an electronic computer, not shown, and oscillates a laser beam L modulated correspondingly to that signal. The laser beam scanner 14 scans the beam L along the drum surface portion between the charger 10 and the developing device 11 in the direction of the bus line of the drum to thereby form on the surface of the drum a latent image corresponding to the signal S.

The developing device 11 of the first printer mechanism I contains yellow (Y) developing toner therein, the second developing device contains magenta (M) developing toner therein, the third developing device contains cyan (C) developing toner therein, and the fourth developing device contains black (BK) developing toner therein, also, a picture element signal S(Y) corresponding to the yellow component image of a color image is input to the laser beam scanner 14 of the first printer mechanism I, a signal S(M) corresponding to the magenta component image is input to the laser beam scanner of the second printer mechanism II, a signal S(C) corresponding to the cyan component image is input to the laser beam scanner of the third printer mechanism III, and a signal S(BK) corresponding to the black component image is input to the laser beam scanner of the fourth printer mechanism IV.

When the main switch of the apparatus is closed, the supply of power to for rotative driving of the laser beam scanners 14 of the printer mechanisms I–IV and other necessary process devices takes place and also the supply of power to the heater of the fixing device 6 takes place and thus, the apparatus effects its warming-up operation. When the laser is turned on and each scanner reaches its predetermined number of revolutions and the fixing roller reaches its predetermined temperature, the printer apparatus becomes ready for color image formation.

When cut-sheet-like transfer paper P as an image receiving member is inserted onto the paper supply guide 51 of the paper supply mechanism 5, the leading end edge of the transfer paper is detected by a first photointerrupter 52 and a start signal (a print sequence start signal) is produced. By this start signal, the drums 9 of the printer mechanisms I–IV start to rotate. Simultaneously therewith, the driving rollers 3 and 4 are driven and the screen belt 2 for conveying the transfer paper P thereon also begins to move in the direction of the arrow.

The transfer paper P is supplied onto the screen belt 2 through a pair of registers 53, a paper supply guide 55, a pair of registers 56 and a paper supply guide 57. The transfer paper P on the screen belt 2 is subjected to corona discharge by an adsorbing charger 59 and is reliably absorbed to the screen belt 2. This charger 59 is provided with an electrically conductive guide 58 as an opposed electrode, and this opposed electrode 58 will be particularly effective if grounded.

Further, when the leading end edge of the transfer paper P intercepts the photointerrupters 60Y, 60M, 60C and 60BK on the downstream side thereof, image formation on the rotating drums 9 of the printer mechanisms I–IV is started by the signals. That is, a yellow image as a color component of the color image is formed on the surface of the drum 9 of the first printer mechanism I, a magenta image is formed on the surface of the drum 9 of the second printer mechanism II, a cyan image is formed on the surface of the drum 9 of the third printer mechanism III, and a black image is formed on the surface of the drum 9 of the printer mechanism IV. The principles of latent image formation and development in each printer mechanism are well known as the Carlson process and therefore need not be described.

The transfer paper P is conveyed toward the fixing device 6 successively through the lower portions of the first to fourth printer mechanisms I–IV by movement of the screen belt 2, and in the process of the passage of the transfer paper through the respective mechanisms, the image by the yellow toner formed on the surface of the drum 9 of the first printer mechanism I, the image by the magenta toner formed on the surface of the drum 9 of the second printer mechanism II, the image by the cyan toner formed on the surface of the drum 9 of the third printer mechanism III and the image by the black toner formed on the surface of the drum 9 of the fourth printer mechanism IV are successively transferred onto the surface of the transfer paper in superposed relationship by the transfer dischargers 12 of the respective mechanisms, whereby a color image is formed on the surface of the transfer paper. When the transfer paper P passes through the fourth printer mechanism IV, it is electrically discharged by a discharger 61 supplied with an AC voltage and is separated from the screen belt 2 without producing any discharge pattern. The transfer paper P then rides onto a separating pawl 61*a* and enters the fixing device 6 and the image by the color toners formed thereon is fixed, whereafter the transfer paper P is discharged as a color image print out of the apparatus through the outlet 7. When the transfer paper P has been discharged out of the apparatus, rotation of all devices except the fixing device is stopped and thus, a series of printing cycles are completed.

The photointerrupters 60Y, 60M, 60C and 60BK as detector means disposed upstream of the respective transfer stations to detect the leading end edge of the transfer paper P are disposed between the respective mechanisms on the route of the screen belt 2 to the first to fourth printer mechanisms I–IV and serve to detect the passage of the transfer paper P through each mechanism portion and determine the image formation starting timing of each mechanism. Designated by 62 and 63 are tension rollers for imparting tension to the screen belt 2. The tension roller 62 is rotatable but its position is fixed to the body. On the other hand, the tension roller 63 is rotatable and rockable in the direction of the arrow and absorbs slack in the belt 2.

Figure 2:
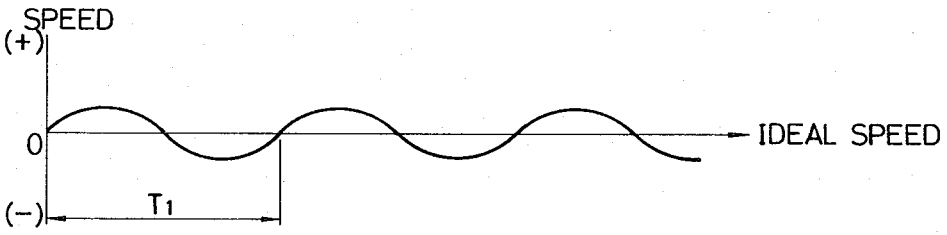
FIGS. 2 and 5 show variations in speed.
Figure 3:
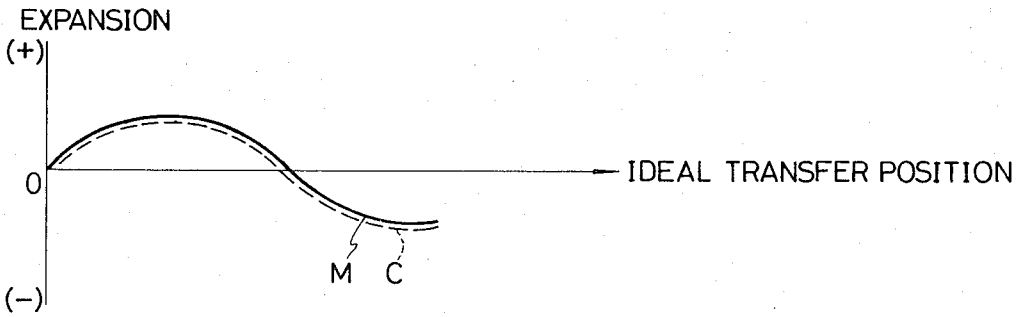
FIGS. 3 and 6 show variations in expansion of transferred images.

Now, in the present embodiment, the screen belt 2 is driven due to the friction force by the driving roller 4. This driving roller 4 is designed so that the peripheral length thereof is equal to the spacing between the respective transfer stations (the distance of the screen belt between the respective transfer stations) H. That is, if the diameter of the driving roller 4 is D, the driving roller 4 is designed to have the relation that $\pi D = H$. When the driving roller 4 has some eccentricity resulting from the working or assembly thereof, the peripheral speed of the roller 4 may be high and low at a position whereat the belt 2 is in contact with the roller 4 and thus, the movement speed of the screen belt 2 does not become constant but varies in a sine-like fashion as shown in FIG. 2. However, according to the construction of the present embodiment, even if the period $T_1$ of the sine wave is produced, the time of this period $T_1$ is coincident with the time during which the transfer paper P on the screen belt 2 moves from one transfer station to the next transfer station. Accordingly, if the amount of expansion or contraction of the toner image then transferred onto the transfer paper in two different transfer stations (the second and third printer mechanisms II and III), in the direction of conveyance of the transfer paper, is plotted, it is such as shown in FIG. 3.

That is, even if, as compared with the ideal transfer condition in which no expansion or contraction is created in the transferred toner image, the transfer condition of the toner image varies in a sine-like fashion as described above, the phase angle of eccentricity of the driving roller 4 at each color transfer starting position is always constant and therefore, the phases of the sine wave of the transferred image also are always coincident with each other. Therefore, no relative color misregistration between the various colors occurs in the toner image on the transfer paper.

Figure 4:
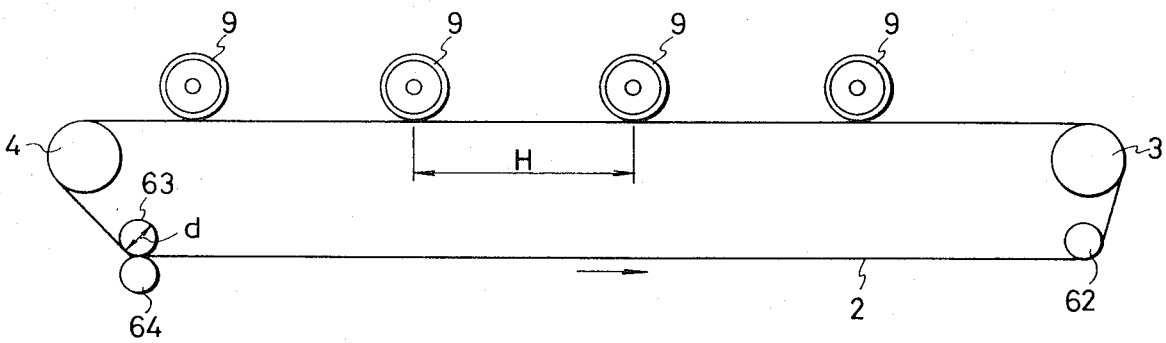
FIG. 4 is a cross-sectional view showing another embodiment of the present invention.

Another embodiment of the present invention will now be described. FIG. 4 shows a cross-sectional view of the essential portions of the present embodiment. In FIG. 4, members functionally similar to those in the first embodiment are given similar reference numerals and need not be described. In the present embodiment, the driving roller 4 of the first embodiment is a rotatable follower roller and instead, the roller 63 is the driving roller and the screen belt 2 is nipped by and between the roller 63 and a pinch roller 64. At this time, the rollers 3, 4, 62 and 64 are rotated by the screen belt 2.

Also, the driving roller 63 is designed such that twice the peripheral length thereof is coincident with the distance between the respective transfer stations (the distance of the screen belt 2 between the respective transfer stations) H.

Figure 5:
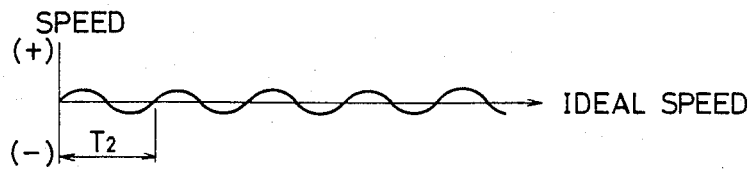

That is, if the diameter of the driving roller 63 is d, $2\pi d = H$. The then speed of the screen belt 2 is a sine wave of period $T_2$ as previously described and as shown in FIG. 5. Here, a time twice as long as the period $T_2$ is coincident with the time until the transfer paper on the screen belt moves to the next transfer station.

If the amount of expansion or contraction of the then transferred image in the direction of conveyance is plotted, it is such as shown in FIG. 6 and again, the phases of the sine wave of the image are coincident with each other and therefore, no relative misregistration between the various colors on the image occurs.

Figure 7:
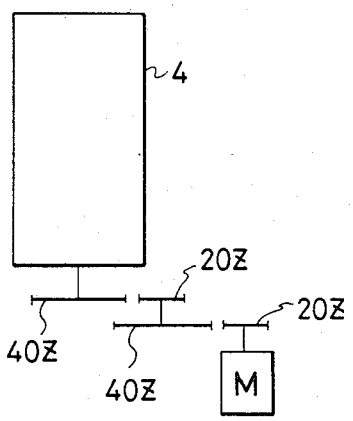
FIG. 7 is a cross-sectional view showing a gear train.

What has been described about the driving roller in the first embodiment shown in FIG. 1 also applies to the gear train for driving the driving roller 63 in the second embodiment shown in FIG. 4. FIG. 7 shows an example of the gear train for driving the driving roller 4. The gear train is comprised of a combination of forty teeth to twenty teeth so as to provide a reduction gear ratio of 2:1. That is, it is effective that the reduction gear ratio is an integer.

Figure 6:
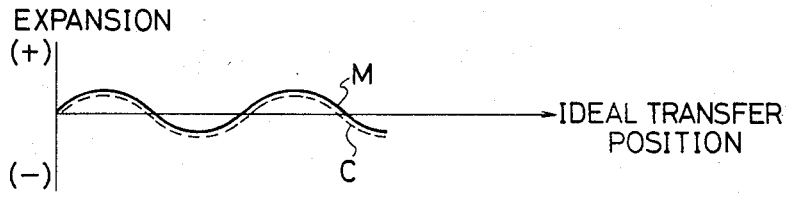

Therefore, even if the gears have eccentricity, the phase angle of eccentricity of each gear is always constant when the transfer paper passes through each transfer station and thus, as shown in FIGS. 3 and 6, it is possible to prevent any relative color misregistration from occurring.

In the above-described embodiments, the transfer paper which is the image receiving member is in the form of a cut sheet, but the present invention also functions effectively in the case of a long or continuous sheet. When an image receiving member in the form of a long sheet is to be conveyed, use may be made of the above-described endlessly moving holding member for image receiving members and in addition, as shown in FIG. 8, the image receiving member itself in the form of a long sheet may be directly driven and the present invention can be applied to the rotative driving means for this driving the sheet.

Figure 8:
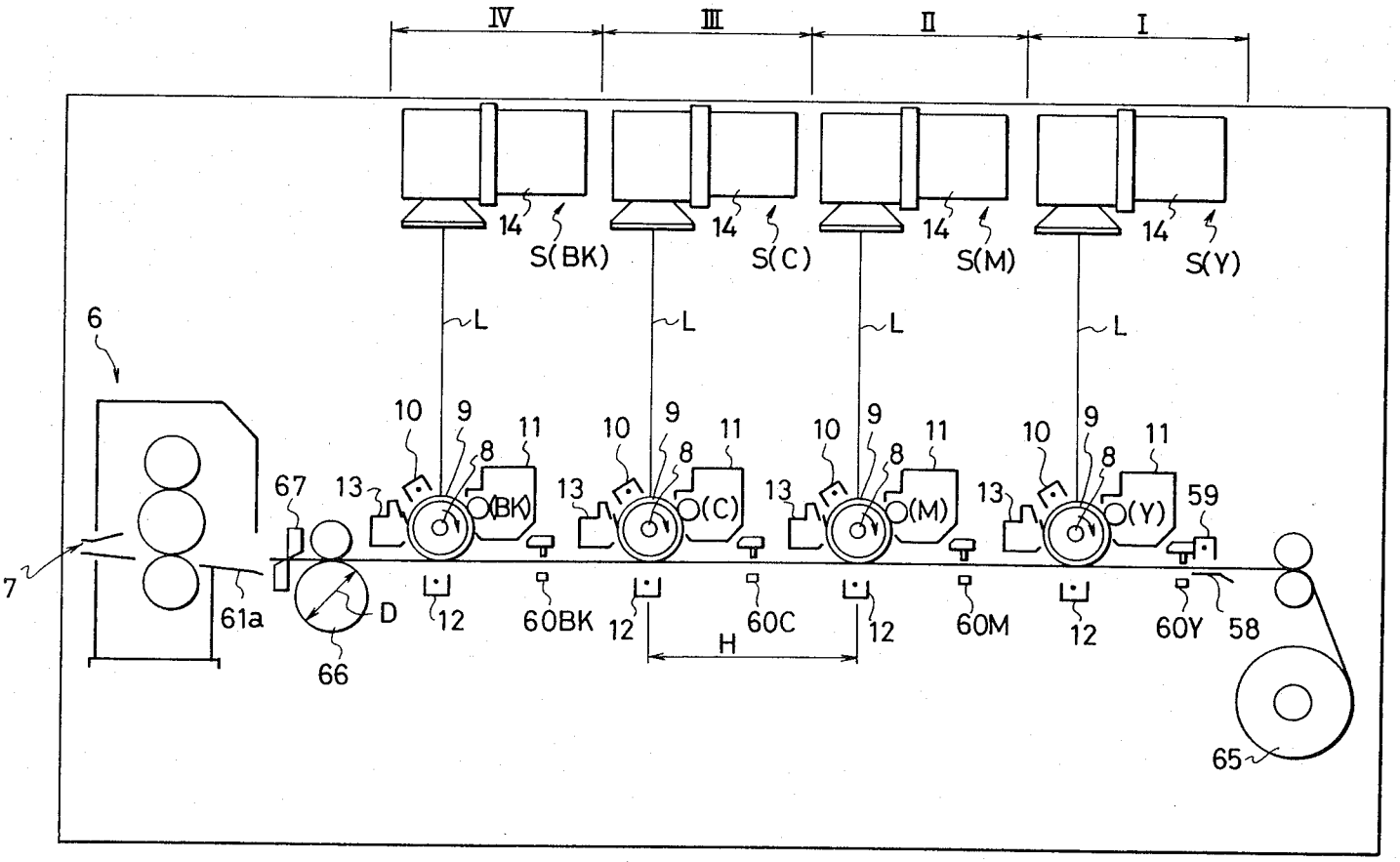
FIG. 8 is a cross-sectional view showing an embodiment of the present invention in which the image receiving member is long or continuous.

In FIG. 8, reference numeral 65 designates a rolled image receiving member, and the image receiving member between the respective image processing stations is driven by a driving roller 66 to which the present invention in applied. After a predetermined multiplex image transfer has been completed, the image receiving member is cut by a cutter 67 and discharged out of the apparatus through the fixing device 6. As regards the driving of such a long sheet, the long sheet is conveyed with the images at the opposite ends thereof being sufficiently nipped between a pair of rollers or with a tractor wheel being brought into mesh engagement with apertures formed at predetermined intervals in the opposite ends of the image receiving member. Also, the timing at which the laser beam is written into the photosensitive mediums can be set by detecting a mark, a slit or the like formed in the image receiving member 65 by the detector means 60Y, 60M, 60C, 60BK.

In the above-described embodiments, a case where four color toners are used has been shown by way of example, but of cource, the present invention is also effective for an apparatus which does not include a printer mechanism using black toner or a multiplex image forming apparatus which uses a color toner different from the black toner. The present invention is also applicable to copying apparatus for forming copy images on the basis of originals other than the above described printer and, in this case, an original supporting table will be provided instead of the laser light source of FIG. 1.

What I claim is:

1. An image receiving member conveying device for a multiplex image forming apparatus in which a plurality of images are superposed on an image receiving member and made into a final image, said device comprising:

rotative driving means for moving the image receiving member by rotation;

a plurality of image processing stations disposed along the direction of movement of said image receiving member at which stations images can be formed on the image receiving member passing therethrough; and means for conveying the image receiving member through said image processing stations, the distance between adjacent ones of said image processing stations being integer times the amount by which the image receiving member is conveyed by one full rotation of said rotative driving means.

2. The device of claim 1, wherein said image receiving member is conveyed by an endlessly moving holding member and said rotative driving means drives said endlessly moving holding member.

3. The device of claim 1, wherein said rotative driving means rotates to directly convey the image receiving member.

4. The device of claim 1 or 2, wherein said image receiving member is a cut sheet.

5. The device of claim 1 or 2, wherein said image receiving member is a substantially continuous sheet.

6. The device of claim 1, wherein said rotative driving means includes a drive source and transmission means for transmitting driving motion to said rotative driving means, said transmission means including gears having an integer gear ratio.

7. An image receiving member conveying device for a multiplex image forming apparatus in which a plurality of images are superposed on an image receiving member and made into a final image, said device comprising:

driving roller means for moving the image receiving member by rotation;

a plurality of image processing stations disposed along the direction of movement of said image receiving member for forming toner images corresponding to the image receiving member being conveyed, the toner images being transferred to the image receiving member as it passes through said stations; and means for conveying the image receiving member through said image processing stations, the distance between adjacent ones of said image processing stations being integer times the amount by which the image receiving member is conveyed by one full rotation of said driving roller means.

8. The device of claim 7, wherein said image processing stations transfer toner images of different colors to the image receiving member.

9. The device of claim 7, wherein said image processing stations form yellow, magenta and cyan color toner images and form a full color image on the image receiving member.

10. The device of claim 7, wherein said driving roller means includes a drive source and transmission means for transmitting driving motion to said driving roller means, said transmission means including gears having an integer gear ratio.

* * * * *